US006012190A

United States Patent [19]

Rogers

[11] Patent Number: 6,012,190

[45] Date of Patent: Jan. 11, 2000

[54] FOLDABLE BED WITH COLLAPSIBLE SINUOUS SPRINGS

[75] Inventor: W. Clark Rogers, Denton, N.C.

[73] Assignee: Pharma Corporation, Denton, N.C.

[21] Appl. No.: 09/121,140

[22] Filed: Jul. 23, 1998

[51] Int. Cl.[7] ..... A47C 23/00

[52] U.S. Cl. ..... 5/722; 5/250; 5/717; 5/260; 267/97; 267/102

[58] Field of Search ..... 5/249, 250, 251, 5/262, 717, 719, 722, 261, 253, 260; 267/97, 98, 102, 107, 108

[56] References Cited

U.S. PATENT DOCUMENTS

| | | | |
|---|---|---|---|
| 1,085,232 | 1/1914 | Young | 5/262 |
| 3,888,473 | 6/1975 | Mandusky et al. | 5/260 X |
| 4,377,279 | 3/1983 | Schulz, Jr. et al. | 5/250 X |
| 5,254,851 | 10/1993 | Fontana | 5/260 X |

*Primary Examiner*—Michael F. Trettel
*Attorney, Agent, or Firm*—Myers Bigel Sibley & Sajovec

[57] ABSTRACT

A body support moveable between unfolded and folded positions comprises: serially interconnected body, cavity and seat sections defined by respective upper and lower grids and including resilient members. The body, cavity and seat sections have their upper and lower grids positioned to be substantially coplanar in the unfolded position, and the seat section overlies the body section in the folded position. The resilient members of the seat section are generally planar and are arranged in a plurality of transverse rows. The resilient members are pivotally attached to the seat section upper and lower grids such that, in the unfolded position, the resilient members of the seat section are erect and extend substantially normal to the seat section upper and lower grids, and in the folded position, the resilient members of the seat section pivot relative to the seat section upper and lower grids to bring the seat section upper and lower grids adjacent each other. The seat section lower grid further comprises a lower border wire which comprises a pair of longitudinal runs and a transverse run therebetween. The transverse run of the upper border wire is positioned above and interconnected with a row of the seat section resilient members spaced farthest from the cavity section; also, the transverse run of the lower border wire is spaced rearwardly from the seat section resilient members. The seat section upper grid comprises a pair of upper border wires, each of which extends longitudinally above a respective lower border wire longitudinal run. A transitional border wire has a pair of longitudinal runs and a transverse run positioned therebetween. The transitional border wire is pivotally interconnected with the seat section lower grid. The transitional border wire transverse run is spaced rearwardly from the resilient members and above the lower border wire transverse run.

35 Claims, 4 Drawing Sheets

FOLDABLE BED WITH COLLAPSIBLE SINUOUS SPRINGS

FIELD OF THE INVENTION

The present invention relates generally to motion furniture, and relates more particularly to a foldable bed that can be stored within a chair or sofa.

BACKGROUND OF THE INVENTION

Foldable beds, and particularly those folding beds which are stored within other furniture items, are an attractive bedding option for consumers with restricted living space. Typically a foldable bed folds upon itself either one or two times for easy storage, then unfolds into a bed for sleeping. The bed generally includes a mattress that is sufficiently flexible to fold upon itself and a frame which serves as both the supporting bed frame and a restraining unit for the mattress in its folded position. The typical frame includes a body section pivotally attached at one end to the end of an intermediate cavity section, the opposite end of which is attached to a seat section; these sections are serially aligned horizontally in the unfolded position, and are folded back upon one another such that the body section and seat section are substantially parallel to one another and are perpendicular to the cavity section in the folded position. The frame is often mounted in an upholstered sofa or chair frame into which the bed frame and mattress are folded and stored when not in use. Cushions are then placed upon the folded mattress for use of the unit as a sofa or chair.

To date, foldable beds have exhibited a number of shortcomings. One general area of dissatisfaction is the sleeping comfort of the bed. For storage purposes, it is desirable that the mattress fold into the thinnest package possible. The need for a compactly folded mattress is particularly important if the mattress and frame are attached to a sofa or chair, since the mattress and frame must fit within the walls of the sofa or chair, which likely has style or ergonomic restrictions. Thick, firm mattresses that would provide suitable sleeping comfort are too bulky to be folded into the space available in many sofa or chair styles; in particular, transitional and contemporary styles often have either a low seat height or an "off-the-floor" front profile and thereby have limited space available in which to store a bed. Many present sofas have addressed the size constraint by employing a mattress that is either (a) thin and easily folded into a thin unit, (b) soft and easily crushed, or (c) a combination of each. The result of such compromises is often an unsatisfactory sleeping surface.

Attempts have been made to address the aforementioned problem. One solution has been the development of so-called "collapsible" springs that comprise some or all of the supporting springs in the mattress. These springs are generally planar and are pivotally interconnected at each end to a pair of wire grids that are adjacent and parallel with the upper and lower upholstery faces of the mattress. When the bed is in its unfolded position, the springs are upright and are oriented to be parallel with the head and foot end faces of the mattress and orthogonal to the upper, lower, and lateral faces of the mattress. However, as the bed moves to its folded position, the springs pivot relative to the wires comprising the grids so that the mattress upper surface is drawn closer and shifts longitudinally relative to the mattress lower surface. As a result, the distance between the upper and lower mattress surfaces (i.e., the thickness of the mattress) is significantly decreased, thereby giving the mattress the appearance of having "collapsed". Examples of collapsible springs suitable for use in foldable bedding are illustrated in U.S. Pat. Nos. 4,489,450, 4,620,336, 4,654,905, and 5,184,809 and 5,539,944 to Miller and U.S. Pat. No. 5,257,424 to Rogers; the disclosure of these patents are hereby incorporated herein by reference in their entireties.

The use of collapsible springs can complicate the folding of the mattress. Also, because the upper and lower mattress surfaces have shifted relative to one another in the folded position, the mattress length is typically reduced in order for the mattress to fold upon itself and fit within the cavity of a conventional seating unit.

One approach, illustrated in U.S. Pat. No. 5,257,424 to Rogers, is to add an additional pivoting section to the mattress at the foot end of the seat section. This approach requires, of course, that the frame and the mechanism controlling the movement thereof have configurations that differ from those used with conventional mattresses. Another approach to this problem is described in U.S. Pat. No. 5,642,536 to Miller (the disclosure of which is hereby incorporated herein by reference in its entirety), which includes a slightly modified mattress frame that has a foot-end leg that is pivotally interconnected with the frame nearer the foot end than is conventional. As a result, in the folded position, the leg presses deeply into the head section of the mattress, thereby "clearing" additional space for the collapsed springs. Unfortunately, this approach requires the aforementioned modifications to the frame and can be deleterious to the head section of the mattress.

SUMMARY OF THE INVENTION

In view of the foregoing, it is an object of the present invention to provide a foldable bed that includes collapsible springs but that utilizes relatively inexpensive materials and assembly methods.

It is another object of the present invention to provide a foldable bed having collapsible springs that can utilize slightly modified conventional bed frame configurations.

It is a further object of the present invention to provide a foldable bed that utilizes a mattress of standard length without major modification of existing folding mechanisms.

These and other objects are satisfied by the present invention, which is directed to a mattress or other body support for a foldable bed and components employed therein, wherein the body support is moveable between unfolded and folded positions. The body support comprises: serially interconnected body, cavity and seat sections defined by respective upper and lower grids and including resilient members. The body, cavity and seat sections have their upper and lower grids positioned to be substantially coplanar in the unfolded position, and the seat section overlies the body section in the folded position. The resilient members of the seat section are generally planar (i.e., they are the "collapsible"-type springs discussed hereinabove) and are arranged in a plurality of transverse rows. The resilient members are pivotally attached to the seat section upper and lower grids such that, in the unfolded position, the resilient members of the seat section are erect and extend substantially normal to the seat section upper and lower grids, and in the folded position, the resilient members of the seat section pivot relative to the seat section upper and lower grids to bring the seat section upper and lower grids adjacent each other. The seat section lower grid further comprises a lower border wire which comprises a pair of longitudinal runs and a transverse run therebetween. The transverse run of the lower border wire is positioned below and interconnected with a row of the seat section resilient members spaced farthest from the cavity section; also, the transverse run of the lower border wire is spaced rearwardly from the seat section resilient members. The seat section upper grid comprises a pair of upper border wires, each of which extends longitudinally above a respective lower border wire longitudinal run. A transitional border wire has a pair of longitudinal runs and a transverse run positioned therebetween. The transitional border wire is pivotally interconnected with the seat section lower grid. The transitional border wire transverse run is spaced rearwardly from the resilient members and above the lower border wire transverse run. In this configuration, the transitional border wire is positioned to support the upper surface of the mattress and effectively lengthen the body support.

As the body support moves from the unfolded to the folded position, the transitional border wire pivots relative to the upper and lower grids such that the transverse run thereof extends beyond the transverse run of the lower border wire. Preferably, the transitional border wire transverse run is positioned substantially the same distance from the cavity section as the rearmost upper runs of the resilient members. As a result, the transitional border wire has folded into a position into which it need not be the component that extends farthest from the cavity section and thereby limits the length of the bed.

In a preferred embodiment, a first flexible member extends between the transverse run of the transitional border wire and the upper grid, and a second flexible member extends between the transverse runs of the lower border section and the transitional border wire. These flexible members are in tension as the body support is in its unfolded position to assist in retaining the transitional border wire in position.

DETAILED DESCRIPTION OF THE INVENTION

The present invention will now be described more particularly hereinafter with reference to the accompanying drawings, in which present embodiments of the invention are shown. The invention can, however, be embodied in many different forms and should not be limited to the embodiments set forth herein; rather, these embodiments are provided so that this disclosure will be thorough and complete and will fully convey the convey the scope of the invention to those skilled in the art.

The present invention is related to foldable beds and other foldable body supports that can be unfolded into a generally horizontal unfolded position, in which the bed is generally horizontally aligned, with the head end of the bed being nearest the seating unit and the foot end being farthest therefrom, and a folded position within a sofa or other seating unit, in which the bed folds upon itself and is stored within a storage cavity in the seating unit. The locations, positions and movements of certain components of the foldable bed will be described hereinafter by reference to their positions relative to other components of the bed when the bed is in its unfolded position. As used herein, "forward" and derivatives thereof and "front" and derivatives thereof refer to the direction defined by a vector parallel to a surface underlying the bed and seating unit and extending from the foot end of the unfolded bed toward the head end. The terms "rear," "rearward," and derivatives thereof refer to the direction opposite the forward direction; i.e. the direction defined by a vector extending parallel to the underlying surface from the bed head end to the bed foot end. Together, the forward and rearward directions form the "longitudinal" directions of the bed. The terms "lateral," "outer," and derivatives thereof refer to the directions defined by vectors originating at a longitudinal bisecting the bed and extending parallel to the underlying surface and perpendicular to the forward direction. The terms "inward," "inner," "inboard," and derivatives thereof refer to the directions that are opposite the lateral directions; i.e., the directions defined by vectors originating at the lateral edges of the bed and extending toward the aforementioned bisecting plane. Together, the inward and lateral directions form the "transverse" directions of the bed.

Figure 1:
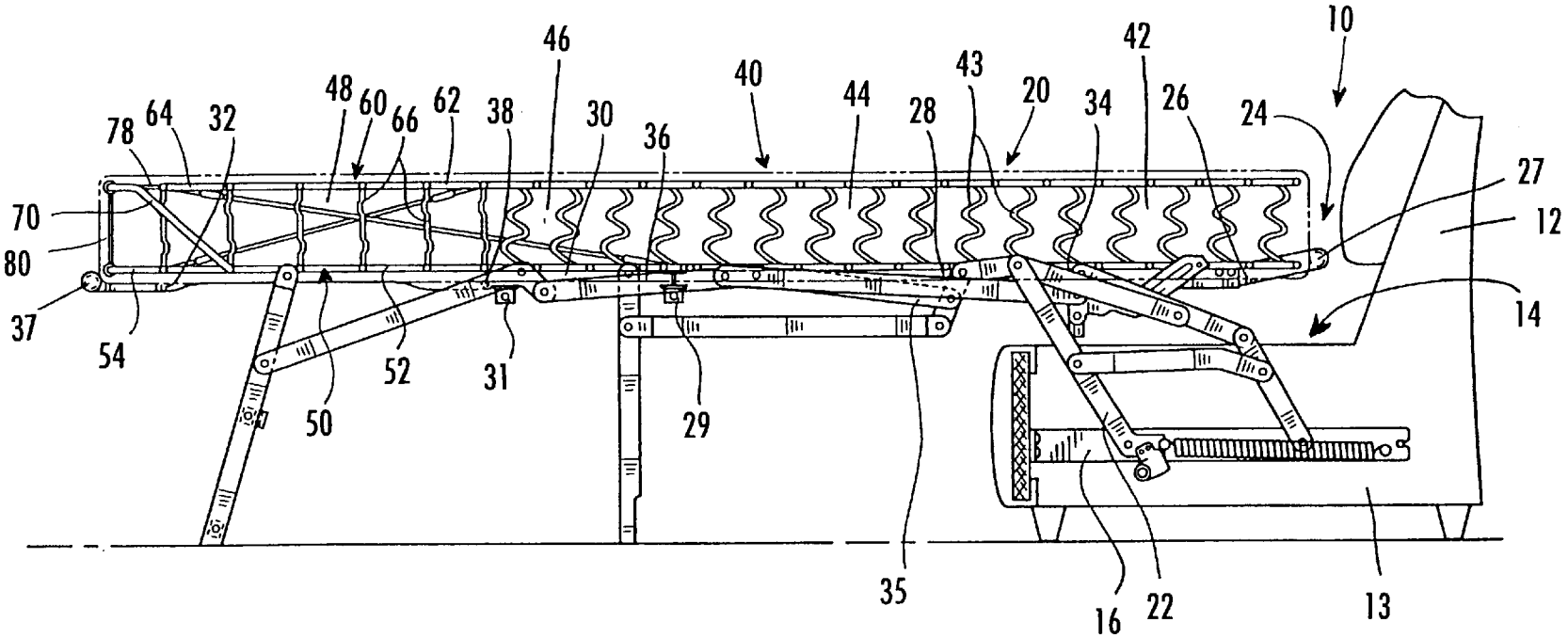
FIG. 1 is a fragmentary side view of a foldable bed of the present invention in its unfolded position.

Referring now to the drawings, FIG. 1 shows a sofa-sleeper, illustrated broadly at 10, that includes a foldable bed 20. The sofa includes a back rest 12 atop a base 13, the walls of which define a cavity 14 within which the foldable bed 20 is stored in its folded position. Although a sofa is illustrated herein and is preferred, the present invention is suitable for use with other seating units, such as couches, pit-style sofas, love seats, chairs, and the like, within which a foldable bed can be stored, is also suitable for use with other structures into which a bed can be folded (such as a cabinet or chest), or can be constructed as a stand-done unit.

A pair of mounting rails 16 (only one of which is illustrated herein) are mounted to the inner surfaces of the lateral walls of the base 13. These mounting rails 16 provide a mounting platform for a folding mechanism 22 that controls the retraction and extension of the folded bed 20 into and out of the sofa cavity 14. The individual links comprising the folding mechanism 22 are known to those skilled in this art and need not be described in detail herein. Also, although the folding mechanism 22 illustrated herein is preferred, those skilled in this art will appreciate that any number of folding mechanisms that control the retraction and extension of a folded mattress into and out of a seating unit can be used with the present invention. Exemplary alternative mechanisms are illustrated in U.S. Pat. No. 5,257,424 to Rogers and U.S. Pat. No. 5,642,536 to Miller.

Figure 5:
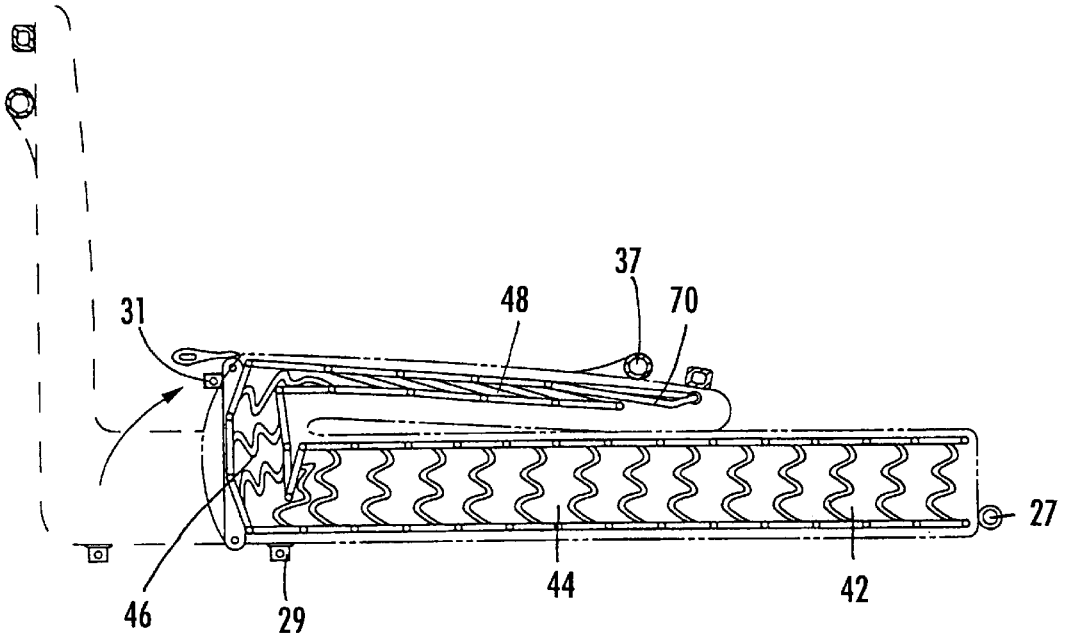
FIG. 5 is a fragmentary side view of the foldable bed of FIG. 1 with the seat section folded to an upright intermediate position.
Figure 6:
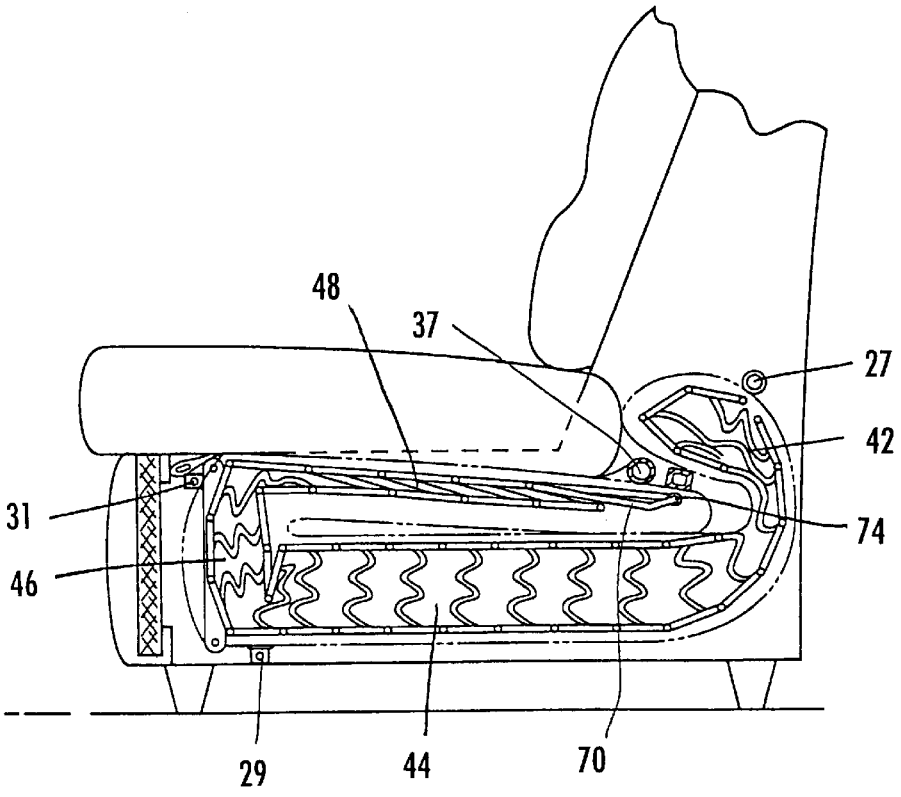
FIG. 6 is a side view of the enlarged portion of the mattress of FIG. 2 showing the bed in its folded position.

The foldable bed 20 (FIG. 1) comprises a frame 24 and a mattress 40 which are interconnected and which move in concert with one another. The frame 24 comprises four serially and pivotally interconnected sections: a head section 26, a body section 28, a cavity section 30, and a seat section 32. Each of these frame sections comprises a pair of side rails (only one of which is illustrated herein) having a generally L-shaped profile, each of which supports a respective lateral edge of the mattress 40 from beneath and extends upwardly therefrom to prevent lateral movement of the mattress 40. The bed 20 is movable between an unfolded and generally horizontal position (FIG. 1), in which the head, body, cavity, and seat sections 26, 28, 30, and 32 are serially and horizontally disposed, and a folded position (FIGS. 5 and 6), in which the body and seat sections 28, 32 are generally horizontal, the seat section 32 overlies the body section 28, the cavity section 30 is generally upright, and the head section 26 is disposed either horizontally (as shown in FIG. 5 prior to retracting into the cavity 14) or generally vertically (as shown in FIG. 6 after retracting into the cavity 14). The pairs of rails comprising the frame 24 are mirror images of one another about a vertically-disposed plane of symmetry that bisects the bed longitudinally.

The rails of the head section 26 (FIG. 1) are pivotally interconnected at their rearward ends to the forward ends of the body section rails at a pivot 34. In turn, the body section rails are pivotally interconnected at their rearward end to the forward ends of the cavity section rails at a pivot 36, and the cavity section rails are pivotally interconnected at their rearward ends to the forward ends of the seat section rails at a pivot 38. Movement of the frame sections 26, 28, 30, 32 between the unfolded and folded positions is controlled by an extension mechanism 35, which comprises a series of pivotally interconnected links that are interconnected with the frame section rails. Those skilled in this art will appreciate that, although the illustrated extension mechanism 35 is preferred, other mechanisms suitable for folding and unfolding mattresses between folded and unfolded positions can also be used with the present invention. Exemplary alternative mechanisms are illustrated in U.S. Pat. No. 4,850,065 to Swiderski et al., U.S. Pat. No. 4,985,945 to Robinson, U.S. Pat. No. 4,905,328 to Pokorny, and the aforementioned patents to Rogers and Miller.

In addition to having a pair of side rails, the frame head section 26 further comprises a cross member 27 (FIG. 1) which interconnects the head section rails at their forward ends to define the forward end of the frame 24. Similarly, a cross member 37 extends between the rearward ends of the rails that comprise the frame seat section 32 and thereby defines the rearward end of the frame 24. In addition, a cross member 29 extends between the rails of the body section 28 beneath the mattress 40, and a cross member 31 extends between the rearward ends of the rails of the cavity section 30 beneath the mattress 40. The cross members 29 and 31 provide strength to the bed 20 and permanent attachment points for the mattress 40 that prevent longitudinal movement of the mattress 40 relative to the frame 24.

The mattress 40 (FIG. 1) comprises a head section 42, a body section 44, a cavity section 46, and a seat section 48, each of which overlies and moves in concert with its corresponding frame section 26, 28, 30, 32 into and between the folded and unfolded positions. The mattress 40 includes upper and lower pads (not shown) which cover the internal components of the mattress 40. The mattress lower pad overlies a deck (also not shown) that spans the space between corresponding side rails and between the head section cross member 27 and the seat section cross member 31. As noted hereinabove, the mattress 40 is fixed to the frame 24 via threaded fasteners (not shown) inserted through the lower pad and the deck and into the cross members 29 and 31. These fixed attachment points prevent the mattress 40 from shifting longitudinally relative to the frame 24, as such shifting can disrupt folding of the mattress 40 and the bed 20.

The mattress head, body, and cavity sections 42, 44, and 46 include a plurality of conventional Bonnell-type helical coil springs 43 (FIGS. 1, 5, and 6) which are arranged in an array of transverse rows and longitudinal columns. The springs 43 are oriented so that the longitudinal axis of each helix is generally upright. The uppermost and lowermost coils of springs 43 in adjacent rows are interconnected by helical wires 45. The springs 43 comprising the rearmost row in the cavity section 46 include a flattened portion in the rearmost portions of their upper and lower coils for interconnection with the seat section 48. Of course, other types of resilient members, such as the planar sinuous springs described below, can also be employed in the head, body and cavity sections 42, 44, 46.

As can be seen in FIGS. 1 through 6, the seat section 48 of the mattress 40 comprises: a plurality of vertically disposed sinuous collapsible springs 66 arranged in an array of transverse rows and longitudinal columns; a plurality of lower grid wires 52 that, along with a lower border wire 54, form a lower grid 50; a plurality of upper grid wires 62 that, in conjunction with a pair of upper border wires 64 and a transitional border wire 70, form an upper grid 60; a plurality of lower helical interconnecting wires 68; and a plurality of upper helical interconnecting wires 68. The upper grid 60 is positioned just beneath the mattress upper pad, and the lower grid 50 is positioned just above the mattress lower pad.

Each of the sinuous collapsible springs 66 (FIG. 2) is generally planar, preferably between about 4 and 8 inches in height, and essentially identical to each of the other collapsible springs 66. The generally planar structure and function of the springs 66 are described in detail in U.S. Pat. No. 5,642,536 to Miller and need not be repeated herein. Those skilled in this art will appreciate that other collapsible spring configurations, such as those illustrated in U.S. Pat. Nos. 4,654,905 and 5,184,809 to Miller, may also be suitable for use with the present invention.

In addition, the upper and lower grid wires 52, 62 and the lower and upper helical wires 68, 69 are described in detail in U.S. Pat. No. 5,642,536 to Miller, and need not be described in detail herein. Other structures suitable for pivotal mounting of collapsible springs are described in U.S. Pat. Nos. 4,654,905 and 4,489,450 to Miller, the disclosures of which are hereby incorporated herein by reference in their entireties.

The lower border wire 54 (FIG. 2) forms the lateral and foot end edges of the periphery of the lower grid 50. The lower border wire 54 includes a pair of longitudinal runs 56 (only one of which is shown herein) that arcuately merge with a transverse run 58. The longitudinal runs 56 are interconnected with the lateralmost lower grid wires 52 via a clip or other connecting device. The transverse run 58 is positioned between about 1 and 5 inches from the rearmost row of springs 66. Typically, the lower border wire 54 is formed of a heavy gauge wire strand approximately 0.1875 inches in diameter.

The upper grid 60 (FIG. 2) includes two upper border wires 64 (only one of which is illustrated herein) that extend longitudinally to form the lateral edges of the upper grid 60. The lateralmost upper grid wires 62 are attached to the upper border wires 64 via hollow clips, although any method recognized by those skilled in the art to be suitable for the interconnection of the upper grid wires 62 to the upper border wires 64 may be used with the present invention. The aforementioned materials and dimensions described above as suitable for the lower border wire 54 are also suitable for the upper border wires 64.

Figure 2:
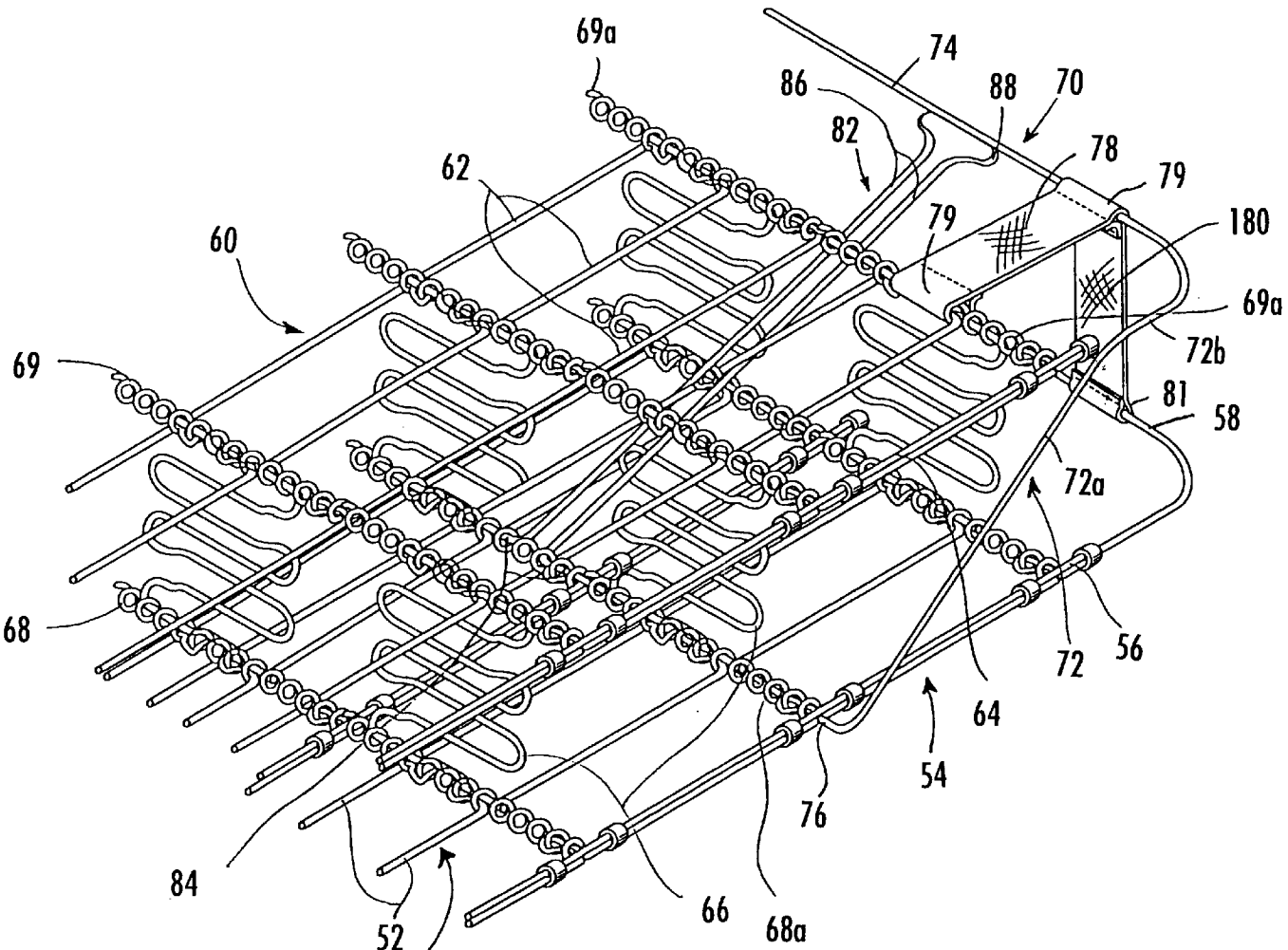
FIG. 2 is an enlarged partial perspective view of the foot end of the foldable bed of FIG. 1 in its unfolded position showing the interconnection of the collapsible springs, grid wire sections, and border wire sections.

Still referring to FIG. 2, the transitional border wire 70, which is formed of a heavy gauge wire as described above, includes a pair of longitudinal runs 72 (only one of which is illustrated herein), a transverse run 74, and a pair of short transverse segments 76. The transverse segment 76 extends through the lower helical wire 68*a* that interconnects the second rearmost row of springs 66 to the lower grid 50. The longitudinal run 72 includes a sloping portion 72*a* that extends from the transverse segment 76 upwardly and rearwardly to a position just rearward of the rearmost row of springs 66 and a horizontal portion 72*b*, which extends longitudinally above and merges with the transverse run 74; in doing so, the horizontal portion 72*b* matches the contour of the rearmost portion of the longitudinal run 56 of the lower border wire 54.

Referring again to FIG. 2, a horizontal fabric strap 78 or other flexible member extends from the transverse run 74 to the upper helical wire 69*a* that interconnects with the rearmost row of springs 66 to the upper grid wire 62. The strap 78 is attached at each end via a loop 79 sewn therein. Also, a vertical fabric strap 80 or other flexible member extends from the transverse run 74 of the transitional border wire 70 to the transverse run 58 of the lower border wire 54. Again, the attachments of the strap 80 between these border wires 54, 70 are achieved via the sewing of a loop 81 at each end of the strap 80.

Still referring to FIG. 2, a reinforcing member 82 extends upwardly and rearwardly from the lower helical wire 68*a* to the transverse run 74 of the transitional border wire 70. The reinforcing member 82 serially includes a pair of transverse segments 84 that are inserted into the lower helical wire 68*a*, a pair of shafts 86 that extend between the helical wire 68*a* and the transverse run 74, and a flattened loop 88. The flattened loop 88 is welded or otherwise fixed to the transverse run 74.

Folding of the bed 20 into its folded position begins with the bed 20 in its unfolded position (FIG. 1). In the unfolded position, the rails of the head, body, cavity, and seat sections 26, 28, 30, and 32 are serially aligned and generally horizontally disposed. Accordingly, the corresponding mattress head, body, cavity and seat sections 40, 42, 46, and 48 are serially aligned and disposed horizontally above the frame 24. The collapsible springs 66 of the mattress seat section 48 are disposed in an upright condition.

Figure 3:
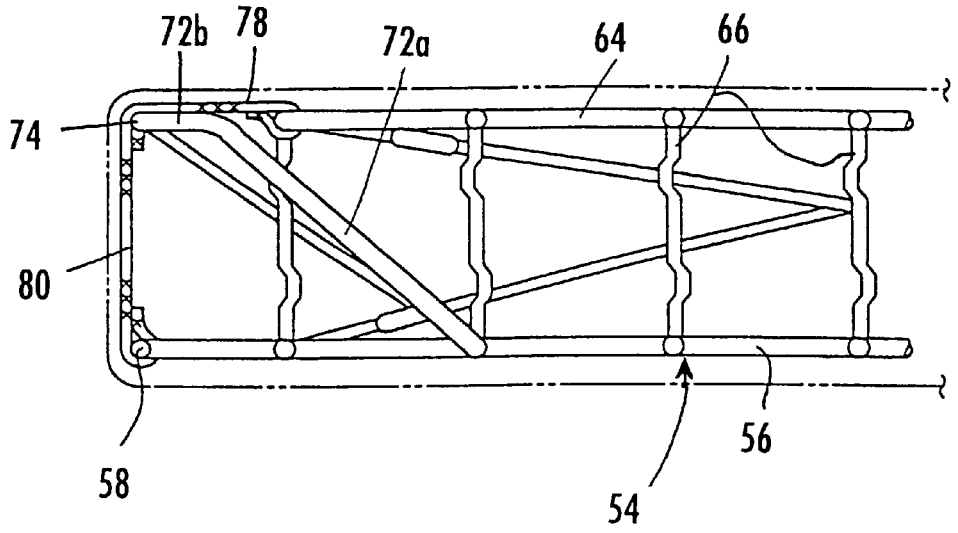
FIG. 3 is a side view of the enlarged portion of the mattress illustrated in FIG. 2 with the mattress in its unfolded position.

As can be seen in FIG. 3, in the unfolded position, the transitional border wire 70 is disposed such that the sloping portion 72*a* of the longitudinal run 72 extends from the lower helical wire 68*a* upwardly and rearwardly, the horizontal portion 72*b* extends horizontally above the lower border wire 54, and the transverse run 74 is positioned directly above the transverse run 58 of the lower border wire 54. Both the horizontal strap 78 and the vertical strap 80 are in tension as they extend away from the transverse run 74 to, respectively, the rearmost upper grid wire 52 and the lower border wire transverse run 58. The reinforcing member 82 extends upwardly and rearwardly from the lower helical wire 68*a* to the transverse run 74.

In this configuration, the transitional border wire 70 is positioned such that the upper surface of the bed 20 extends in the rearward direction farther than the rearmost row of springs 66, therefore increasing the useful length of the bed 20. Although there are no springs directly supporting the transitional border wire 70 from underneath, the transitional border wire 70 can still provide considerable support to the foot end of the unfolded bed 20, particularly in response to a forwardly-directed force. Both the transitional border wire 70 itself and the reinforcing member 82 provide resistance to such a force (which is the type of force the bed 20 may be exposed to when someone leans against the edge of the bed 20). The transitional border wire 70 is prevented from pivoting upwardly under such a force by the tension in the vertical strap 80. Also, because the transverse run 74 of the transitional border wire 70 is located somewhat adjacent (within about 1 to 5 inches, and preferably between about 2 to 3 inches) to the rearmost row of springs 66, an occupant sitting on the foot end of the bed notices little, if any, lack of support at this location. As a result, the bed 20 is effectively lengthened.

To fold the bed 20, an upwardly directed force is applied to the cross member 37 to initiate folding of the bed 20 from its unfolded position (FIG. 1). In response to the rising of the crossmember 37, the frame seat section 32 rotates about the pivot 38 until the bed 20 arrives at an intermediate position (shown in FIG. 4) in which the seat section rails are generally upright. The movement of the frame 24 is controlled by the extension mechanism 35.

Simultaneous with the movement of the frame, the upper grid 60 pivots about a pivot axis positioned within the upper helical wire 69 that interconnects transverse sections of the upper grid wires 62 with the flattened portions of the rearmost row of coil springs 43, and the lower grid 50 pivots about a pivot axis positioned within the lower helical wire 68 that interconnects transverse sections of the lower grid wires 62 with the flattened portions of the lower coils of the rearmost coil springs 43. The remainder of the frame 24 and the mattress 40 remain substantially stable. The upper grid 60 shifts longitudinally relative to the lower grid 50, with the result that the upper grid 60 extends past the frame seat section cross member 37.

Figure 4:
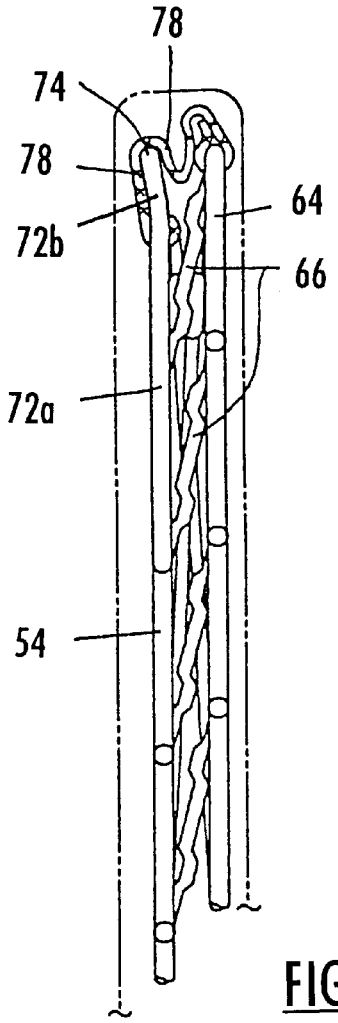
FIG. 4 is a side view of the enlarged portion of the mattress illustrated in FIG. 2 with the mattress in its folded position.

The action of the collapsible springs 66 and the lower and upper grid wires 52, 62 is best understood by examination of FIGS. 3 and 4. FIG. 3 shows the collapsible springs 66 in their upright position. As the bed 20 moves to the folded position, the upper grid 60 is forced toward the foot end of the bed 20 relative to the lower grid 50; because the upper and lower runs of the spring 66 can pivot within the helical wires 68, 69, the springs 66 move in response to the relative movement of the upper grid 60 to the "collapsed" position illustrated in FIG. 4.

As the upper grid 60 moves rearwardly relative to the lower grid 50 and the springs 66 pivot to their collapsed condition, the transitional border wire 70 pivots downwardly relative to the lower grid 50 to a position in which (a) the sloping portion 72*b* of the longitudinal run 72 is substantially parallel with the longitudinal run 56 of the lower border wire 54 and (b) the transverse run 74 of the transitional border wire 70 resides substantially even with the transverse run 58 of the lower border wire 54 and with the rearmost upper grid wire 62. Both the horizontal and vertical straps 78, 80 are collapsed and no longer in tension. Thus, in the folded position, the upper and lower grids 50, 60 extend rearwardly substantially the same distance, with the transitional border wire 70 folded out of the way.

From the intermediate position illustrated in phantom line in FIG. 5, the bed 20 is then folded into a second intermediate position (bold line in FIG. 5) in which the seat section 34 overlies the body section 30 and the cavity section 32 is generally upright. This movement is also controlled by the extension mechanism 35. The mattress seat section 48 remains in its collapsed condition. Finally, the bed 20 is folded into its folded position (FIG. 6). This movement is controlled by the folding mechanism 22. In the folded position, the frame body section 28 is generally horizontally disposed, the frame seat section 32 is generally horizontally disposed and overlies the body section 28, the frame cavity section 30 is generally upright, and the frame head section 26 is generally upright. In this position, the bed 20 can be stored inside the cavity 14 of the sofa sleeper 10 when not in use.

The foregoing embodiment is illustrative of the present invention, and is not to be construed as limiting thereof. The invention is defined by the following claims, with equivalents of the claims to be included therein.

That which is claimed is:

1. A body support for a foldable bed, said body support being moveable between unfolded and folded positions, said body support comprising:

serially interconnected body, cavity and seat sections defined by respective upper and lower grids and including resilient members, said body, cavity and seat sections having their upper and lower grids positioned to be substantially coplanar in the unfolded position, and said seat section overlying said body section in the folded position;

said resilient members of said seat section being generally planar, arranged in a plurality of transverse rows, and pivotally attached to said seat section upper and lower grids such that, in the unfolded position, said resilient members of said seat section are erect and extend substantially normal to said seat section upper and lower grids, and in the folded position, said resilient members of said seat section pivot relative to said seat section upper and lower grids to bring said seat section upper and lower surfaces adjacent each other;

said seat section lower grid further comprising a lower border wire which comprises a pair of longitudinal runs and a transverse run therebetween, said longitudinal runs of said lower border wire being positioned below and interconnected with a row of said seat section resilient members spaced farthest from said cavity section, and said transverse run of said lower border wire being spaced rearwardly from said seat section resilient members;

said seat section upper grid further comprising a pair of upper border wires, each of which extends longitudinally above a respective lower border wire longitudinal runs; and a transitional border wire having a pair of longitudinal runs and a transverse run positioned therebetween, said transitional border wire being pivotally interconnected with said seat section lower grid, said transitional border wire transverse run being spaced rearwardly from said resilient members and above said lower border wire transverse run when said body support is in the unfolded position.

2. The body support defined in claim 1, further comprising:

a first flexible member extending between said transverse run of said transitional border wire and said upper grid; and a second flexible member extending between said transverse runs of said lower border section and said transitional border wire.

3. The body support defined in claim 2, wherein said first and second flexible members are in tension when said body support is in said unfolded position.

4. The body support defined in claim 2, wherein said first and second flexible members are flexible straps.

5. The body support defined in claim 1, wherein in said unfolded position, said transitional border wire transverse run is at a height substantially equal to that of said upper grid, and wherein in said folded position, said transitional border wire transverse run is longitudinally spaced apart from said lower border wire transverse run and is positioned farther from said cavity section than said lower border wire transverse run.

6. The body support defined in claim 1, wherein said transitional border wire longitudinal runs are bent such that portions thereof are substantially collinear with said upper border wires when said body support is in the unfolded position.

7. The body support defined in claim 1, further comprising at least one reinforcing member that is pivotally interconnected with said lower grid and attached to said transitional border wire transverse run.

8. The body support defined in claim 1, wherein said at least one reinforcing member is fixed to said transitional border wire transverse run.

9. The body support defined in claim 1, wherein said resilient members of said seat section are between about 4 and 8 inches in height, and wherein said transitional border wire transverse section is spaced apart from said lower border wire section transverse run between about 1 and 5 inches when said body support is in said folded position.

10. The body support defined in claim 1, wherein said transitional border wire is pivotally interconnected with said lower grid at a position thereon coincident with a pivot axis of one of said transverse rows of resilient members.

11. The body support defined in claim 10, wherein each of said transitional border wire longitudinal runs includes an inwardly-extending segment, wherein said transverse rows of resilient members are pivotally interconnected to said upper and lower grid surfaces with a plurality of helical wires, and wherein said inwardly-extending segments are interconnected to said lower grid surface with one of said helical wires.

12. A foldable bed, comprising:

(a) a frame comprising serially interconnected rails defining body, cavity and seat sections;

(b) a mattress supported by said frame comprising:

serially interconnected body, cavity and seat sections corresponding to said body, cavity and seat sections of said frame and defined by respective upper and lower grids and including resilient members, said body, cavity and seat sections having their upper and lower grids positioned to be substantially coplanar in the unfolded position, and said seat section overlying said body section in the folded position;

said resilient members of said seat section being generally planar, arranged in a plurality of transverse rows, and pivotally attached to said seat section upper and lower grids such that, in the unfolded position, said resilient members of said seat section are erect and extend substantially normal to said seat section upper and lower grids, and in the folded position, said resilient members of said seat section pivot relative to said seat section upper and lower grids to bring said seat section upper and lower surfaces adjacent each other;

said seat section lower grid further comprising a lower border wire which comprises a pair of longitudinal runs and a transverse run therebetween, said longitudinal runs of said lower border wire being positioned below and interconnected with a row of said seat section resilient members spaced farthest from said cavity section, and said transverse run of said lower border wire being spaced rearwardly from said seat section resilient members;

said seat section upper grid further comprising a pair of upper border wires, each of which extends longitudinally above a respective lower border wire longitudinal runs; and a transitional border wire having a pair of longitudinal runs and a transverse run positioned therebetween, said transitional border wire being pivotally interconnected with said seat section lower grid, said transitional border wire transverse run being spaced rearwardly from said resilient members and above said lower border wire transverse run when said bed is in the unfolded position; and (c) a mechanism for controlling the movement of said frame and said mattress between the unfolded and folded positions.

13. The foldable bed defined in claim 12, further comprising:

a first flexible member extending between said transverse run of said transitional border wire and said upper grid; and a second flexible member extending between said transverse runs of said lower border section and said transitional border wire.

14. The foldable bed defined in claim 13, wherein said first and second flexible members are in tension when said foldable bed is in said unfolded position.

15. The foldable bed defined in claim 13, wherein said first and second flexible members are flexible straps.

16. The foldable bed defined in claim 12, wherein in said unfolded position, said transitional border wire transverse run is at a height substantially equal to that of said grid, and wherein in said folded position, said transitional border wire transverse run is longitudinally spaced apart from said lower border wire transverse run and is positioned farther from said cavity than said lower border wire section transverse run.

17. The foldable bed defined in claim 12, wherein said transitional border wire longitudinal runs are bent such that portions thereof are substantially collinear with said upper border wires when said foldable bed is in the unfolded position.

18. The foldable bed defined in claim 12, further comprising at least one reinforcing member that is pivotally interconnected with said lower grid and attached to said transitional border wire transverse run.

19. The foldable bed defined in claim 12, wherein said at least one reinforcing member is fixed to said transitional border wire transverse run.

20. The foldable bed support defined in claim 12, wherein said resilient members of said seat section are between about 4 and 8 inches in height, and wherein said transitional border wire transverse section is spaced apart from said lower border wire section transverse run between about 1 and 5 inches when said foldable bed is in said folded position.

21. The foldable bed defined in claim 12, wherein said transitional border wire is pivotally interconnected with said lower grid at a position thereon coincident with a pivot axis of one of said transverse rows of resilient members.

22. The foldable bed defined in claim 12, wherein each of said transitional border wire longitudinal runs includes an inwardly-extending segment, wherein said transverse rows of resilient members are pivotally interconnected to said upper and lower grid surfaces with a plurality of helical wires, and wherein said inwardly-extending segments are interconnected to said lower grid surface with one of said helical wires.

23. A wire structure for increasing the usable length of a body support, said wire structure comprising:

a transitional border wire including a pair of longitudinal runs with a transverse run positioned therebetween and further including a pair of inwardly-extending segments attached to said longitudinal runs; and at least one unitary reinforcing member fixed to said transverse run of said transitional border wire and including segments that extend substantially colinearly with said inwardly-extending segments of said transitional border wire for synchronized pivotal movement with said inwardly-extending segments of said border wire.

24. The wire structure defined in claim 23, further comprising a helical wire encircling said inwardly-extending segments and said reinforcing member segments.

25. A body support for a foldable bed, said body support being moveable between unfolded and folded positions, said body support comprising:

serially interconnected body, cavity and seat sections defined by respective upper and lower grids and including resilient members, said body, cavity and seat sections having their upper and lower grids positioned to be substantially coplanar in the unfolded position, and said seat section overlying said body section in the folded position;

said resilient members of said seat section being generally planar, arranged in a plurality of transverse rows, and pivotally attached to said seat section upper and lower grids such that, in the unfolded position, said resilient members of said seat section are erect and extend substantially normal to said seat section upper and lower grids, and in the folded position, said resilient members of said seat section pivot relative to said seat section upper and lower grids to bring said seat section upper and lower surfaces adjacent each other;

said seat section lower grid further comprising a lower border wire which comprises a pair of longitudinal runs and a transverse run therebetween, said longitudinal runs of said lower border wire being positioned below and interconnected with a row of said seat section resilient members spaced farthest from said cavity section, and said transverse run of said lower border wire being spaced rearwardly from said seat section resilient members;

said seat section upper grid further comprising a pair of upper border wires, each of which extends longitudinally above a respective lower border wire longitudinal runs; and a transitional border wire having a pair of longitudinal runs and a transverse run positioned therebetween, said transitional border wire being pivotally interconnected with said seat section, said transitional border wire transverse run being spaced rearwardly from said resilient members and above said lower border wire transverse run when said body support is in the unfolded position.

26. The body support defined in claim 25, further comprising:

a first flexible member extending between said transverse run of said transitional border wire and said upper grid; and a second flexible member extending between said transverse runs of said lower border section and said transitional border wire.

27. The body support defined in claim 26, wherein said first and second flexible members are in tension when said body support is in said unfolded position.

28. The body support defined in claim 27, wherein said first and second flexible members are flexible straps.

29. The body support defined in claim 25, wherein in said unfolded position, said transitional border wire transverse run is at a height substantially equal to that of said upper grid, and wherein in said folded position, said transitional border wire transverse run is longitudinally spaced apart from said lower border wire transverse run and is positioned farther from said cavity section than said lower border wire transverse run.

30. The body support defined in claim 25, wherein said transitional border wire longitudinal runs are bent such that portions thereof are substantially collinear with said upper border wires when said body support is in the unfolded position.

31. The body support defined in claim 25, further comprising at least one reinforcing member that is pivotally interconnected with said lower grid and attached to said transitional border wire transverse run.

32. The body support defined in claim 25, wherein said at least one reinforcing member is fixed to said transitional border wire transverse run.

33. The body support defined in claim 25, wherein said resilient members of said seat section are between about 4 and 8 inches in height, and wherein said transitional border wire transverse section is spaced apart from said lower border wire section transverse run between about 1 and 5 inches when said body support is in said folded position.

34. The body support defined in claim 25, wherein said transitional border wire is pivotally interconnected with said lower grid at a position thereon coincident with a pivot axis of one of said transverse rows of resilient members.

35. The body support defined in claim 25, wherein each of said transitional border wire longitudinal runs includes an inwardly-extending segment, wherein said transverse rows of resilient members are pivotally interconnected to said upper and lower grid surfaces with a plurality of helical wires, and wherein said inwardly-extending segments are interconnected to said lower grid surface with one of said helical wires.

* * * * *

UNITED STATES PATENT AND TRADEMARK OFFICE

CERTIFICATE OF CORRECTION

PATENT NO. : 6,012,190

DATED : January 11, 2000

INVENTOR(S) : W. Clark Rogers

It is certified that error appears in the above-identified patent and that said Letters Patent is hereby corrected as shown below:

On the title page, item [56]

Under paragraph entitled "References Cited" please add the following U.S. Patent Documents --5,184,809; 5,257,424; 5,346,188; 5,539,940; 4,985,945; 4,928,331; 4,918,770; 4,905,328; 4,850,065; 4,811,932; 4,780,918; 4,768,253; 4,694,515; 4,669,134; 4,654,905; 4,620,336; 4,571,755; 4,513,460; 4,489,450; 4,398,311; 4,381,570; 4,253,205; 4,200,941; 4,104,745; 4,004,305; 3,934,281; 3,516,096; 3,284,811; 2,248,093; 457,041--

Change "5,254,851" to read --5,253,851--.

Signed and Sealed this

Twenty-eighth Day of November, 2000

*Attest:*

*Attesting Officer*

Q. TODD DICKINSON

*Director of Patents and Trademarks*